US008997391B2

(12) United States Patent
Rozic et al.

(10) Patent No.: US 8,997,391 B2
(45) Date of Patent: Apr. 7, 2015

(54) FIREARM SIGHT

(71) Applicant: Penn United Technologies, Inc., Cabot, PA (US)

(72) Inventors: Raymond Patrick Rozic, Cabot, PA (US); Todd Eric Waldroup, Fenelton, PA (US)

(73) Assignee: Penn United Technologies, Inc., Cabot, PA (US)

( * ) Notice: Subject to any disclaimer, the term of this patent is extended or adjusted under 35 U.S.C. 154(b) by 0 days.

(21) Appl. No.: 13/720,601

(22) Filed: Dec. 19, 2012

(65) Prior Publication Data

US 2014/0165446 A1 Jun. 19, 2014

(51) Int. Cl.

| | |
|---|---|
| ***F41G 1/00*** | (2006.01) |
| ***F41G 1/02*** | (2006.01) |
| ***F41G 1/10*** | (2006.01) |
| ***F41G 1/26*** | (2006.01) |

(52) U.S. Cl.
CPC .. *F41G 1/02* (2013.01); *F41G 1/10* (2013.01); *F41G 1/26* (2013.01)

(58) Field of Classification Search
USPC ..... 42/111, 135, 136, 137, 138, 139
See application file for complete search history.

(56) References Cited

U.S. PATENT DOCUMENTS

| | | | | |
|---|---|---|---|---|
| 717,478 | A * | 12/1902 | Wesson | 42/139 |
| 2,108,150 | A * | 2/1938 | Swebilius | 42/137 |
| 3,648,374 | A * | 3/1972 | Lewis | 42/136 |
| 3,662,469 | A * | 5/1972 | Charron | 42/137 |
| 3,925,902 | A * | 12/1975 | Gevers | 42/137 |
| 4,388,772 | A | 6/1983 | Maes | |
| 4,628,611 | A * | 12/1986 | Ruffino | 42/137 |
| D352,087 | S | 11/1994 | Stevens et al. | |
| D361,366 | S | 8/1995 | Emerson | |
| 7,526,890 | B1 | 5/2009 | Keng et al. | |
| 7,610,712 | B2 | 11/2009 | Ertl | |
| 7,624,527 | B2 * | 12/2009 | Casas Salva | 42/111 |
| 8,028,454 | B1 * | 10/2011 | Pontillo, II | 42/1.05 |
| 8,296,990 | B2 | 10/2012 | Zukowski et al. | |
| 8,443,542 | B1 * | 5/2013 | Galbraith | 42/132 |
| 2004/0200109 | A1 * | 10/2004 | Vasquez | 42/1.01 |
| 2009/0071053 | A1 * | 3/2009 | Thomele et al. | 42/1.01 |
| 2011/0088539 | A1 * | 4/2011 | Oz | 89/1.4 |

(Continued)

OTHER PUBLICATIONS

Colt Instruction Manual, Colt Gold Cup National Match MK IV/ Series 70 Pistols, 1981, Colt Industries Operating Corp.

(Continued)

*Primary Examiner* — Gabriel Klein
(74) *Attorney, Agent, or Firm* — William F. Lang, IV; Lang Patent Law LLC

(57) ABSTRACT

A sight for a firearm is provided. The sight is structured to fit within a channel defined within the firearm. In some examples, the channel is defined within the slide of a semi automatic handgun. The sight includes a base that fits within the channel, and a visual index portion extending outward from the base. A removable firearm component blocks an open end of the channel, thereby retaining the sight, when the removable firearm component is installed on the firearm. In some examples, a rear sight may be secured within a channel defined within a slide by a firing pin stop. In other examples, a front sight may be secured within a channel defined within a slide by a barrel bushing. Some examples of the sight may include an adjustment mechanism for moving the visual index portion with respect to the base.

21 Claims, 5 Drawing Sheets

(56) References Cited

U.S. PATENT DOCUMENTS

| | | | | |
|---|---|---|---|---|
| 2011/0154710 | A1* | 6/2011 | Hatfield | 42/90 |
| 2012/0198744 | A1* | 8/2012 | Meller et al. | 42/90 |

OTHER PUBLICATIONS

Colt Safety and Instruction Manual, MK IV/Series 80 Pistols: Gold Cup National Match, Delta Gold Cup, 1995, Colt's Manufacturing Company, Inc.

* cited by examiner

FIREARM SIGHT

TECHNICAL FIELD

The present invention relates to firearm sights. More specifically, the invention provides a firearm sight that is held within a channel defined within a component of a firearm, for example, a slide of a semiautomatic handgun, by a removable component of the firearm, for example, a removable component of a slide assembly of a semiautomatic handgun.

BACKGROUND INFORMATION

Firearms are typically aimed by aligning a front sight with a rear sight. A typical front sight includes a post or bead, which is aligned within a U-shaped notch, V-shaped notch, or aperture that is included within a rear sight. By centering the front sight or portion thereof within the rear sight, and aligning the top of the front sight with the target, the firearm may be accurately aimed at the target.

The sights are typically located a short distance from the center of the barrel, so that aligning the sights exactly parallel with the barrel will result in the bullet striking the target below the point of aim, a concept known as parallax. Furthermore, the bullet will drop during flight, producing a curved trajectory. Therefore, it is generally desirable for the sights to be aligned at a slight angle to the barrel, so that perfect horizontal sight alignment will result in a slight upward angle of the barrel. Ideally, this will cause the bullet to pass through the axis of the sights at two distances, first as it is rising, and second as it is falling. The distances at which this occurs can be adjusted by adjusting the position of the sights relative to each other.

The relationship between the point of impact indicated by sight alignment and the actual point of impact of the bullet on the target can be adjusted according to well-known principles. For example, if a shooter desires to move the point of impact of bullets on the target to the right, this can be achieved by moving the rear sight to the right, or the front sight to the left. Similarly, moving the rear sight to the left, or the front sight to the right, will move the point of impact of bullets on the target to the left. Raising the height of the rear sight, or lowering the height of the front sight, will raise the point of impact of bullets on the target. Similarly, lowering the height of the rear sight, or raising the height of the front sight, will lower the point of impact of bullets on the target. Using these well-known principles, a shooter may adjust the position of one or both sights to bring the point of impact of bullets on the target to the point indicated by proper alignment of the sights at a given distance. Additionally, small differences in the manner in which different shooters perceive sight alignment may be present. These small differences, when magnified by the distance to the target, can become significant. Therefore, adjustment of the sights is helpful in ensuring that a given shooter's perception of proper sight alignment results in the proper point of impact on the target.

The means of adjusting sights as described above depends on the type of sights. Sights which are completely fixed must typically be adjusted by filing, or in the case of a revolver, by rotating the barrel to move the front sight. Obviously, completely fixed sights not only make adjustment difficult, but also make replacement of the sights with a different style of sights difficult. Many sights for semi automatic handguns are presently mounted within transverse dovetail cuts defined within the slide, held in place by an interference fit and/or by set screws. These sights can be adjusted for horizontal alignment by moving the sights within the dovetail channels. Vertical adjustment requires either filing or replacement of one or both sights with sights of different heights. The dovetail cuts are not cosmetically optimal, and provide no assistance in centering the sights on the firearm, which is often the optimal position for horizontal alignment. Additionally, installation of sights in dovetail cuts usually requires the use of specialized tools, which may not be in the possession of the shooter. Furthermore, dovetail mounted sights have been known to work loose over time. In particular, repeated removals and installations can loosen an interference fit. Nonetheless, dovetail cuts are popular because they facilitate sight replacement and some horizontal sight adjustment.

Many presently available sights include a means for adjusting the position of the front and/or rear sight relative to the other sight. These sights will often use a screw to bias a portion of the sight in one direction, and a spring to bias the portion of the sight in another direction. One such mechanism is used to control vertical adjustment, and a similar mechanism is utilized to control horizontal adjustment. Often, these sights require cutouts in the slide or other firearm components that specifically accommodate those sights, thereby making it very difficult to replace the sights with a different style of sight. An example is the Elliason style sight that was utilized on some past examples of 1911 style pictures manufactured by Colt. Given the popularity of dovetail cuts, some adjustable sights have been designed to fit standard dovetail cuts, and therefore carry the cosmetic and centering disadvantages inherent in dovetail cuts.

Demands are often placed on firearm sights beyond their use in aiming a firearm. For example, in the case of a semi automatic handgun, a shooter with an injury to one arm may have a need to manipulate the handgun using only one hand. Many training exercises mimic this need. Retracting the slide, as would be necessary for reloading and/or clearing malfunctions, is often accomplished by hooking the rear sight onto a belt, the heel of a shoe, or other convenient surface. The rear sight must therefore be able to withstand the stresses of being used to retract the slide.

Accordingly, there is a need for a firearm sight that is easily installed and/or replaced by the shooter, preferably without tools. Towards this end, there is a need for a firearm sight having a design that provides for automatic centering of the sight on the firearm. There is a further need for a firearm sight that is easily replaceable with other styles of firearm sights. Additionally, there is a need for a firearm sight that provides adjustability without the need for specialized cutouts. Furthermore, there is a need for a firearm sight that avoids the cosmetic disadvantages of previous firearm sights. There is an additional need for a firearm sight that has sufficient strength for use in retracting the slide of a semi automatic handgun.

SUMMARY

A slide assembly for a semiautomatic firearm is provided. The slide assembly includes a slide defining a channel having an open end. A sight includes a base that is structured to fit within the channel, and a visual index portion extending outward from the base. A removable slide assembly component blocks the open end of the channel when installed on the slide, retaining the sight within the channel.

A sight for a firearm is also provided. The sight includes a base that is structured to fit within a channel defined within a firearm. The sight includes a base that is structured to be retained within a channel. A removable firearm component blocks the end of the channel when installed, thereby retaining the sight within the channel.

An improved firearm is also provided. The firearm defines a channel having an open end. A sight includes a base that is structured to fit within the channel, and a visual index portion extending outward from the base. A removable firearm component blocks the open end of the channel when installed on the firearm, retaining the sight within the channel.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
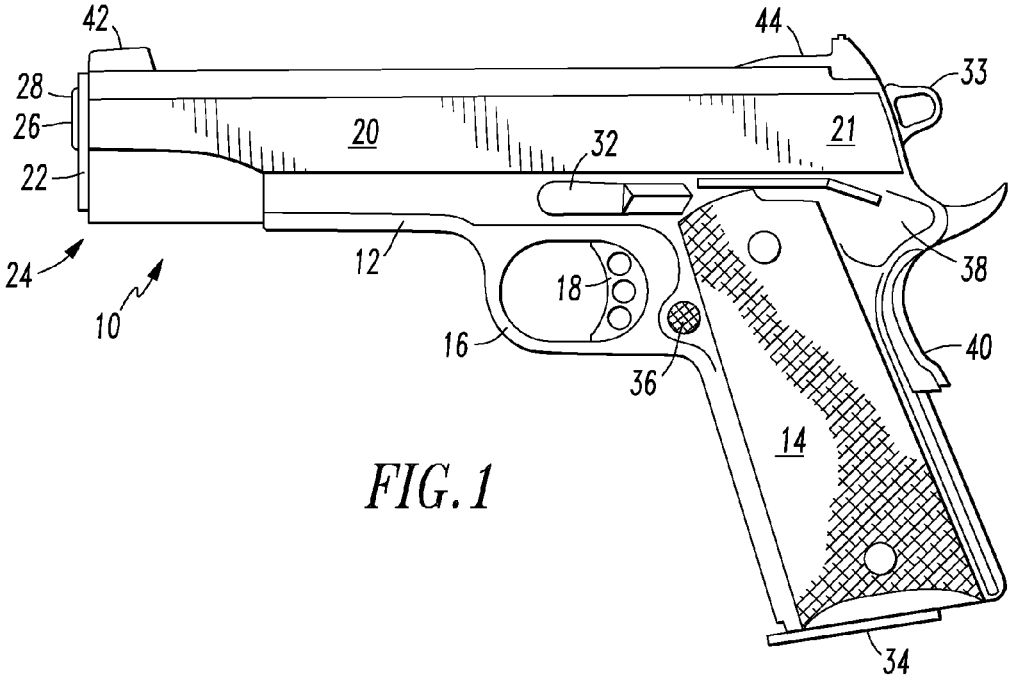
FIG. 1 is a side elevational view of a firearm.

Referring to FIG. 1, a firearm utilizing an example of an improved sight is illustrated. The illustrated firearm 10 is a semiautomatic handgun commonly known as a 1911 style pistol, which was adopted by the United States military in 1911 , and which is currently sold by numerous manufacturers. However, the sight could be used with other semiautomatic handguns, and is not limited to use with semiautomatic handguns. The handgun 10 includes a frame 12 having a grip portion 14, and including a trigger guard 16. A trigger 18 is slidably mounted in the frame 12, behind the trigger guard 16. A slide 20 is reciprocally mounted on the frame, and is biased towards a forward position by a recoil spring (not shown, but well known). A barrel bushing 22 is removably secured within the forward portion 24 of the slide 20, in a manner that is well known to those familiar with 1911 pistols (best shown in FIG. 2). The muzzle 26 of the barrel 28 is supported by the barrel bushing 22. A recoil spring plug 30 is retained in place by the barrel bushing 22. A slide stop 32, serves as a pivot for the breech end of the barrel 28, secures the barrel 28 (and thereby indirectly secures the slide 20) to the frame 12, and may be utilized to hold the slide 20 in a rearward position. A hammer 33 is pivotally secured to the frame 12, to the rear of the rear portion 21 of the slide 20. A magazine 34 fits within the grip portion 14, and is secured in place by a magazine release 36. A thumb safety 38 is provided for blocking movement of the sear (which holds the hammer in a cocked position and is released by the trigger) when desired, and a grip safety 40 is provided for blocking movement of the trigger 18 when the handgun 10 is not being gripped, in a manner that is well known to those familiar with 1911 pistols. A front sight 42 and rear sight 44 are removably secured to the top of the slide 20, in a manner that will be described in greater detail below.

Figure 2:
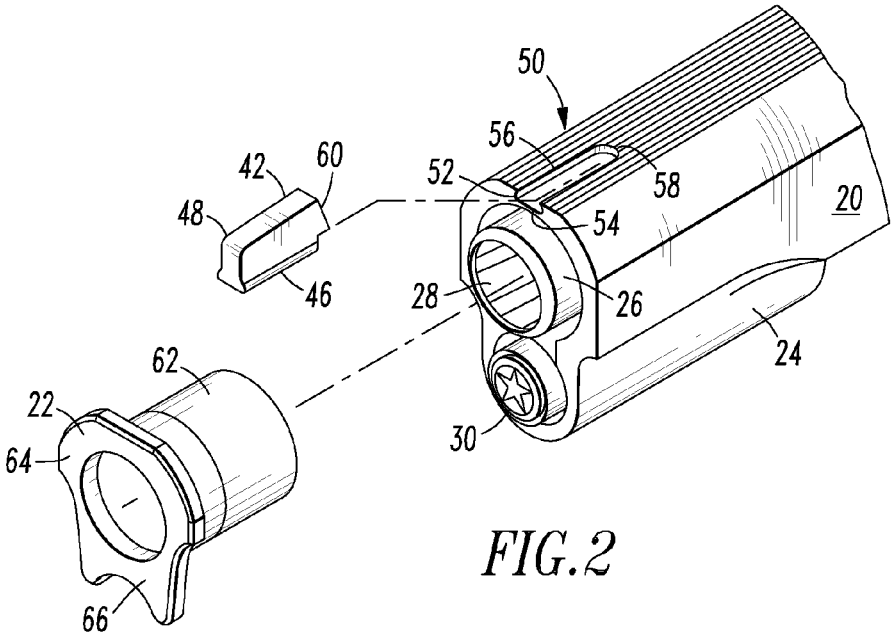
FIG. 2 is a partially exploded isometric view of a muzzle portion of a firearm of FIG. 1, showing the sight removed.

The front sight 42 is best illustrated in FIG. 2. The front sight 42 includes a base 46 and a visual index portion 48, which in the illustrated example is a conventional post. The illustrated example of the base 46 is wider than the post 48. A channel 50 is defined within the forward portion 24 of the slide 20. The illustrated example of the channel 50 is centered on the slide 20, and is aligned with the longitudinal axis of the slide 20. The channel 50 includes an open end 52, corresponding to the front of the slide 20. The lower portion 54 of the channel 50 has a width that is appropriate to receive the base 46. The upper portion 56 of the channel 50 has a width that is appropriate to receive the post 48, but which is too narrow to receive the base 46. The back end 58 of the channel 50 is closed. The front sight 42 may therefore be slid into the channel 50, and is retained therein by the shape of the channel 50. Some examples of the front sight 42 may fit within the channel 50 with an interference fit that resists the front sight falling out of the channel 50, but permits the front sight 42 to be removed by finger pressure.

Figure 3:
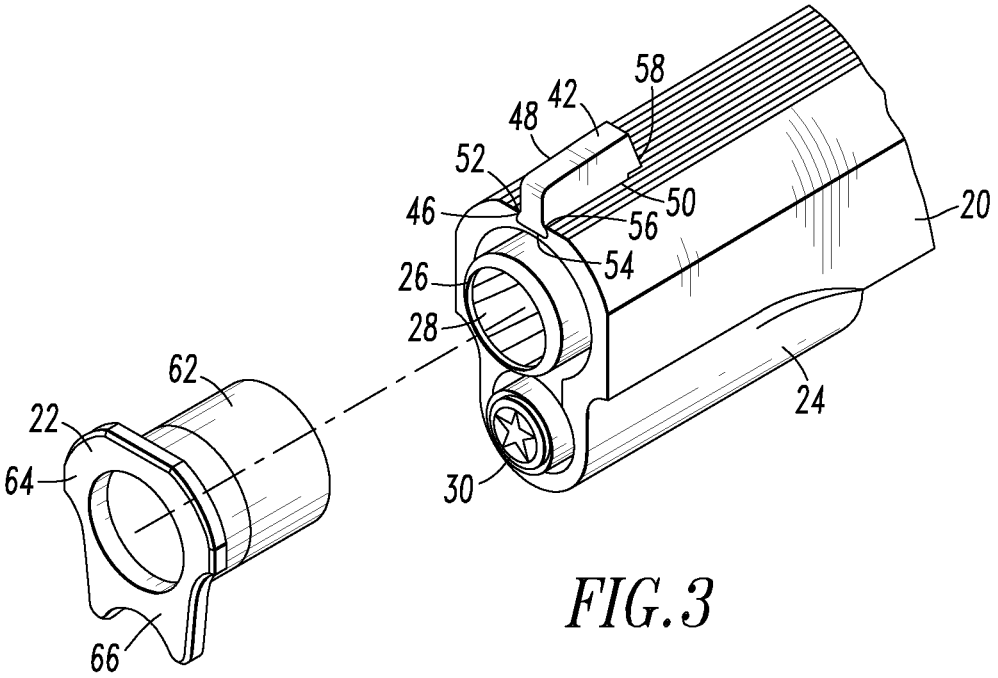
FIG. 3 is a partially exploded isometric view of a muzzle portion of a firearm of FIG. 1, showing the sight installed.
Figure 4:
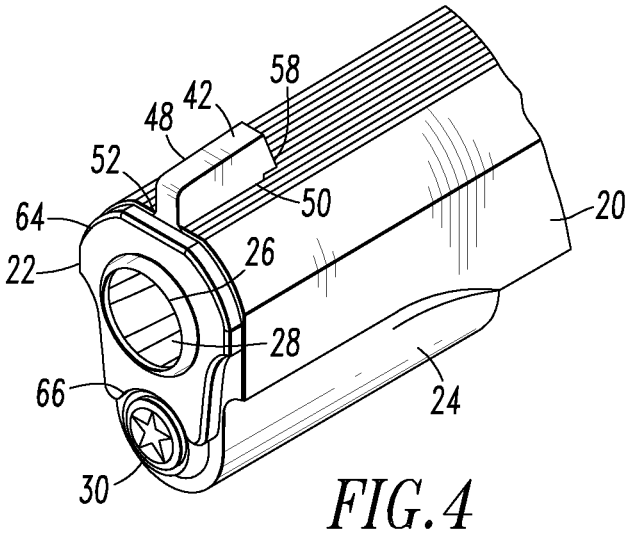
FIG. 4 is an isometric view of a muzzle portion of a firearm of FIG. 1, showing the sight installed.

The process of installing the front sight 42 is illustrated in FIGS. 2-4. Because the front sight 42 is retained by the bushing 22 as explained below, partial disassembly of the pistol 10 is helpful for installing the front sight 42. Disassembly of 1911 style pistols is well known, and is described in pages 26-28 of the Colt Instruction Manual for the *Colt Gold Cup National Match MK IV/Series* 70 , published by Colt Industries Operating Corp. in 1981 , and the entire manual is incorporated herein by reference. With the barrel bushing 22 removed (which is typically done during basic disassembly of the handgun 10 for cleaning, known as "field stripping"), and typically with the slide 22 removed from the frame 12, the front sight 42 is inserted into the channel 50 with its rear face 60 facing rearward, as shown in FIG. 3. Next, the cylindrical portion 62 of the barrel bushing 22 is inserted between the barrel 28 and slide 20, until the flange portion 64 of the barrel bushing 22 abuts the slide 22. The flange portion 64 of the bushing 22 is rotated counterclockwise from its vertical position during insertion so that a lug (not shown, but a well-known, standard part of a 1911 bushing) protruding from the cylindrical portion 62 is aligned with a channel defined within the slide. Once inserted, the bushing is rotated clockwise to engage another channel defined within the slide, retaining the bushing in place. Once the bushing is rotated to its maximum extent in the opposite direction, which is about ¼ turn clockwise from vertical, the slide 22 is placed on the frame 12, and slide stop 32 is inserted into the frame 12. At this point, the recoil spring and recoil spring plug 30 are inserted into the slide, below the barrel. The bushing 22 is again rotated counterclockwise towards its vertical position of FIG. 4, In this position, the recoil spring biases the recoil spring plug 30 against the lower portion 66 of the flange 64, retaining the bushing 22 in this orientation. With the bushing 22 in place, the flange 64 blocks the open end 52 of the channel 50, thereby securing the sight 42 within the channel 50. Any time removing the sight 42 is desired, the barrel bushing 22 can be removed by reversing the above procedure, and then removing the sight 42 from the channel 50.

Figure 5:
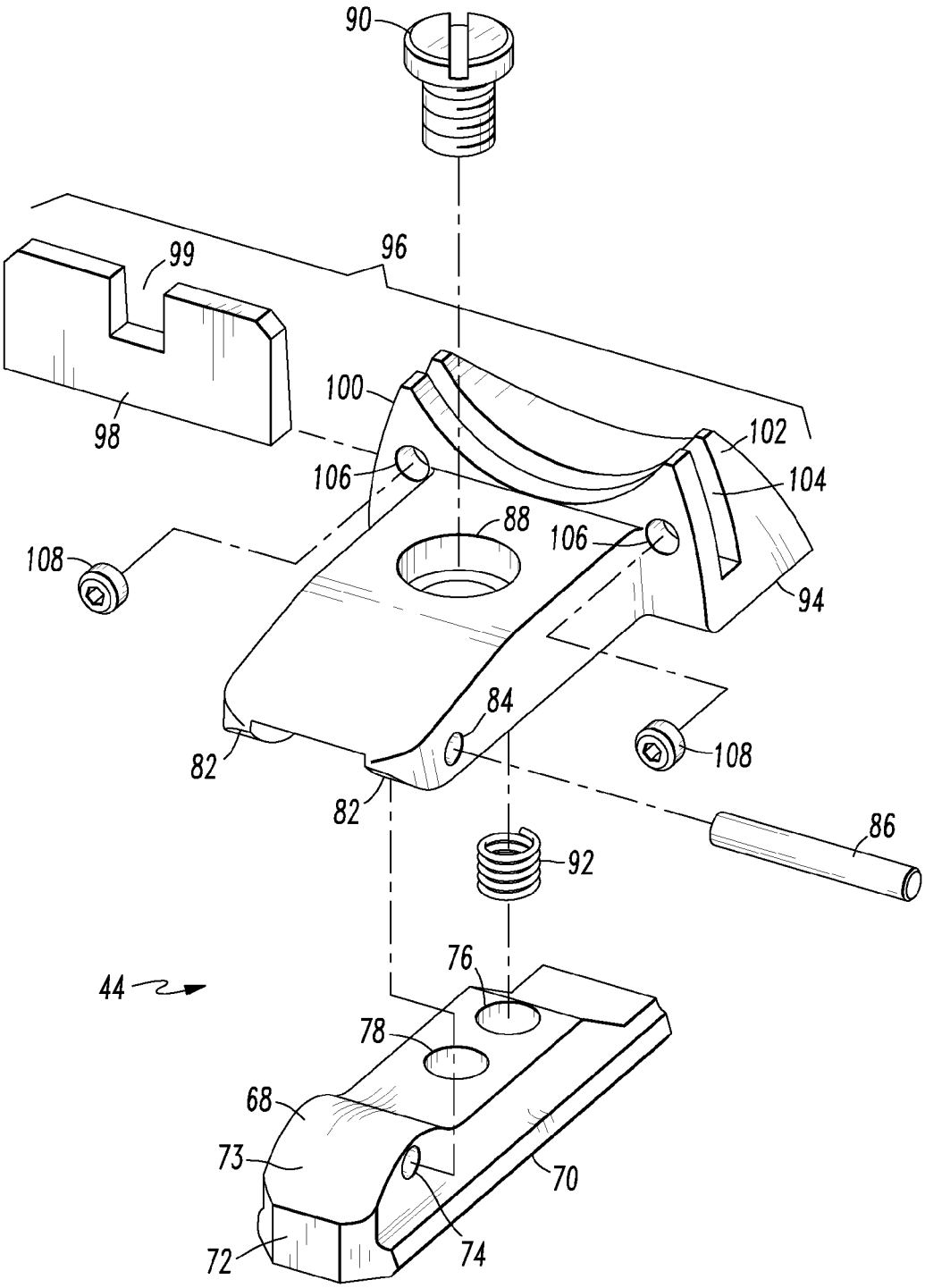
FIG. 5 is a partially exploded isometric view of an example of a rear sight.

Referring to FIG. 5, an example of a rear sight 44 is illustrated. The rear sight 44 includes a base 68. The base 68 has a flange 70 extending outward from its bottom edge, on either side of the base 68. The forward end 72 of the base 68 includes a raised, convex hump 73 defining a hole 74 therethrough.

The base 68 further defines a downwardly extending hole 76, and a downwardly extending threaded hole 78.

An upper arm 80 is secured to the base 68 in a manner that permits adjustment of the position of the upper arm 80 relative to the base 68. In the illustrated example, the upper arm 80 includes a pair of downwardly extending flanges 82 that are structured to be positioned on either side of the hump 73. Each of the flanges 82 defines a hole 84 corresponding to the hole 74 defined within the hump 73, so that a pin 86 may be inserted through the holes 84 and hole 74 to pivotally secure the upper arm 80 to the base 68. The upper arm further defines a hole 88 corresponding to the hole 78, with the illustrated example of the hole 88 being beveled, with a wider top portion than bottom portion. A screw 90 may pass through the hole 88 to threadedly engage the hole 78, Although a slotted head screw 90 is illustrated, a Phillips head screw, Allen head screw, screw with a finger engaging head or knob, or any other style of screw may be utilized. A spring 92 is disposed within the hole 76, and is structured to bias the upper arm 80 away from the base 68. The upper arm 80 may thereby be raised relative to the base 68 by loosening the screw 90, and lowered with respect to the base 68 by tightening the screw 90. The hump 73 remains in contact with the bottom surface of the upper arm 80 during pivoting, resisting unnecessary movement between the upper arm 80 and base 68, and enhancing the precision with which sight adjustments may be made.

The rear portion 94 of the upper arm 80 includes a visual index portion 96. The visual index portion 96 includes a visual index 98, which in the illustrated example is a blade 98 defining a notch 99 therein. Some examples of the visual index portion 96 may also be structured to provide for horizontal movement of the blade 98. The illustrated example includes a forward plate 100 and rearward plate 102 defining a slot 104 therein. The slot 104 is structured to receive the blade 98. In the illustrated example, the forward plate 100 includes a pair of threaded holes 106 that are structured to receive a pair of set screws 108. With the blade 98 within the channel 104, the set screws 108 are tightened against the blade 98, thereby securing the blade 98 in a desired position within the channel 104. Some examples of the blade 98, plate 100, and/or plate 102 may include indicia for accurately positioning the blade 98 within the slot 104.

Figure 6:
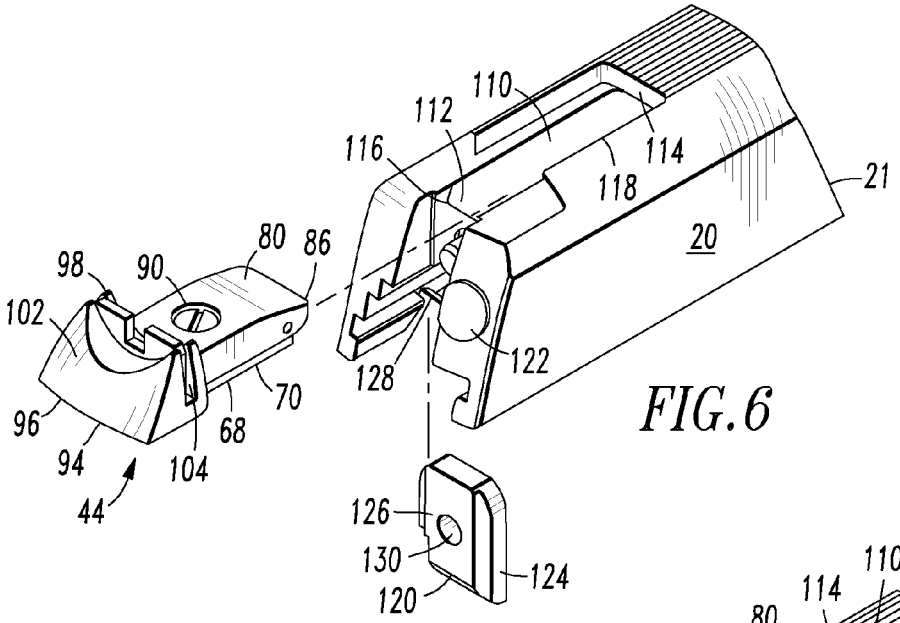
FIG. 6 is a partially exploded isometric view of a rear portion of a slide of a firearm of FIG. 1, showing the rear sight of FIG. 5 removed.
Figure 7:
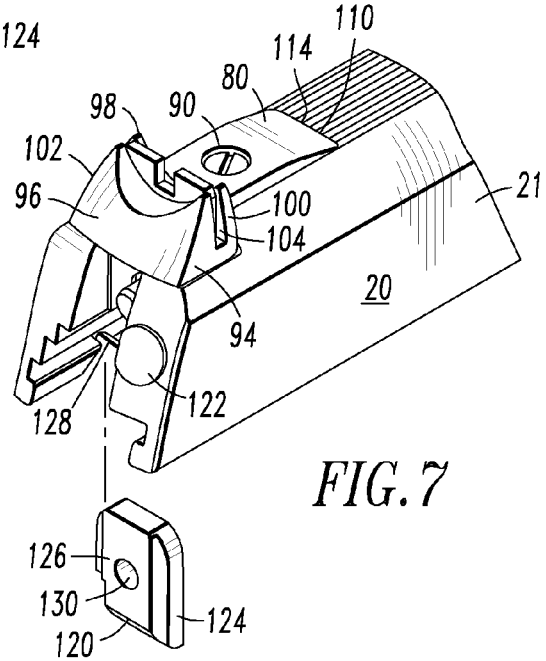
FIG. 7 is a partially exploded isometric view of a rear portion of a slide of a firearm of FIG. 1, showing the rear sight of FIG. 5 installed.
Figure 8:
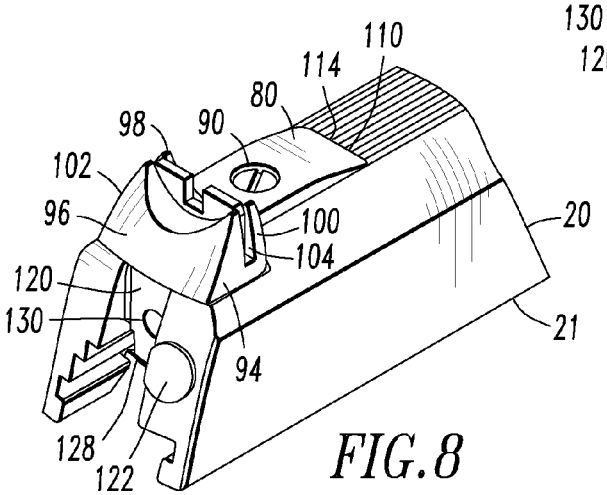
FIG. 8 is an isometric view of a rear portion of a slide of a firearm of FIG. 1, showing the rear sight of FIG. 5 installed.
Figure 9:
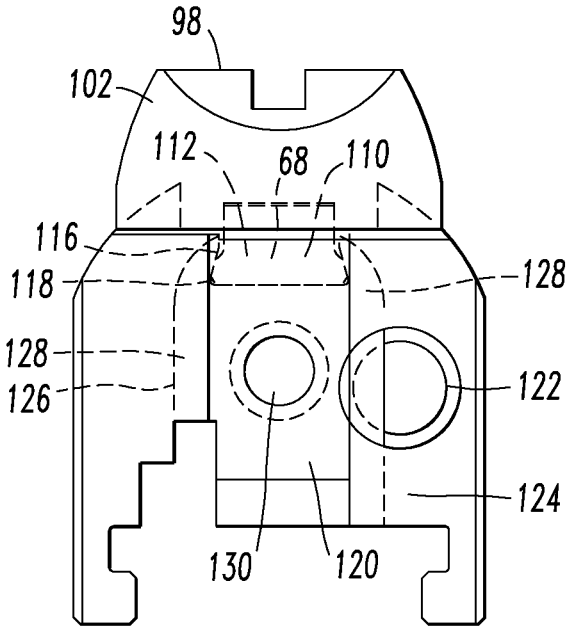
FIG. 9 is a back plan view of a rear portion of a slide of a firearm of FIG. 1, showing the rear sight of FIG. 5 installed.
Figure 10:
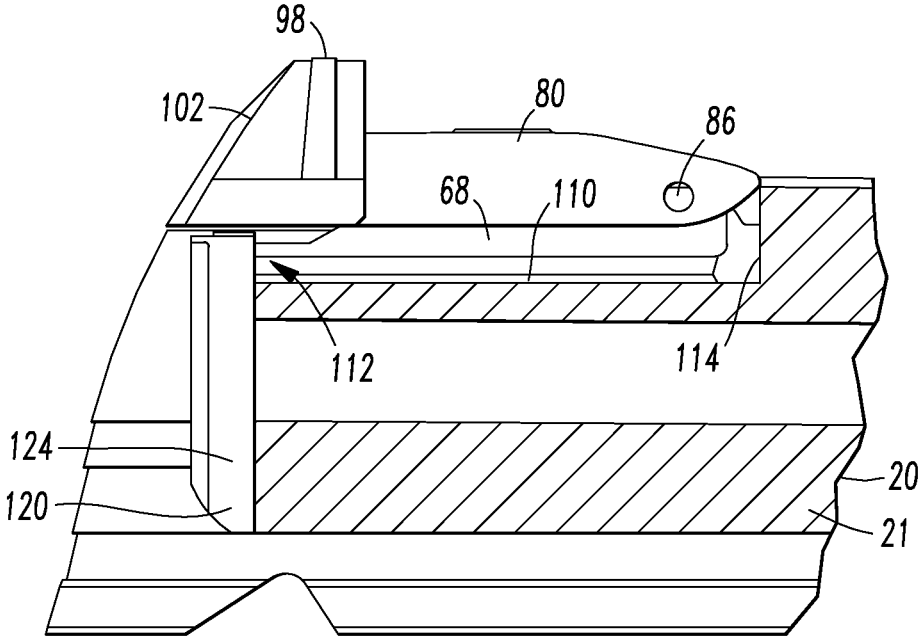
FIG. 10 is a cross sectional side elevational view of a slide of a firearm of FIG. 1, showing the rear sight of FIG. 5 installed.

The installation of the rear sight 44 on a slide 20 is illustrated in FIGS. 6-8. As shown in FIG. 6, the rear portion 21 of the slide 20 defines a channel 110 that is structured to receive the base 68. The illustrated example of the channel 110 is centered on the slide 20, and is aligned with the longitudinal axis of the slide 20. The channel 110 includes a rear open end 112, and a closed forward end 114. The lower portion 116 of the channel 110 is wider than the upper portion 118 of the channel 110. The lower portion 116 of the channel can thereby receive the flange 70 extending from the base 68 of the rear sight 44, while the upper portion 118 resists passage of the flange 70 therethrough. The sight 44 is thereby retained within the channel 110 by the upper portion 118 and closed end 114, as shown in FIGS. 9-10. Some examples of the sight 44 are held within the channel 110 by an interference fit that permits the sight 44 to be installed and removed using finger pressure.

Although the design of 1911 pistols is well known, a brief description of the firing pin stop 120 and its functioning is helpful in understanding how the rear sight 44 is retained within the slide 20. An exploded view of these components is shown in the Colt Instruction Manual for the *Colt Gold Cup National Match MK IV/Series* 70 , page 34 , which was incorporated by reference above. A firing pin stop 120 is structured to be installed within the rear portion 21 of the slide 20, in order to retain both the firing pin as well as the extractor 122. The firing pin stop 120 includes a pair of side edges 124, 126 that are structured to fit within corresponding slots 128 defined within the rear portion 21 of the slide 20. The firing pin stop 120 further defines a central aperture 130 for receiving the back end of a firing pin. The firing pin, which is not shown but which is well known, is an inertial firing pin that is shorter than the firing pin channel defined within the slide 22. The firing pin is held in a rearward position by a firing pin spring. To discharge the pistol, the hammer 33 must strike the back of the firing pin with sufficient force to impart sufficient inertia to carry the firing pin forward against spring pressure so that it strikes a primer with sufficient force to ignite the primer. The firing pin then immediately returns to its rearward position, wherein the back end of the firing pin protrudes through the aperture 130. With the slide 22 removed from the frame 12, the firing pin stop 120 is removed from the slide 20 by pushing the firing pin forward, and then sliding the firing pin stop 120 downward out of the channels 128. Installing the firing pin stop 120 within the slide 20 is accomplished by pushing forward on the firing pin, and then sliding the firing pin stop 120 upward into the channels 128.

To install the rear sight 44 into the slide 20, the firing pin stop 120 is removed. The forward end 72 of the base 68 is then inserted into the channel 110, until the forward end 72 contacts the closed end 114, as shown in FIG. 7. The firing pin stop 120 is then inserted into the channels 128 until it reaches the top of the channels 128, at which point the firing pin protrudes through the aperture 130 to secure the firing pin stop 120 in place, as shown in FIG. 8. At this point, the firing pin stop 120 blocks the open end 112 of the channel 110, thereby securing the sight 44 within the channel 110.

A shooter wishing to utilize a blade 98 having a different style than a currently installed blade 98, for example, replacing a square notch 99 with a V-notch or aperture, replacing a black blade 98 with one having white, colored, or tritium illuminated indicia, may loosen the set screws 108, remove the blade 98, install a new blade 98, and then tighten the set screws 108. Loosening the set screws 108 alternatively facilitates horizontal movement of the blade 98, if desired.

A sight as described above has numerous advantages over presently available sights. The sights are easily installed and replaced by the shooter, allowing the shooter to select whatever style of sight the shooter may prefer. In the illustrated example, the channels 50, 110 are substantially coaxial with the slide 20, so that the sights 42, 44 are automatically centered on the slide 20 when they are installed. The components that retain the sights 42, 44 within the slide 20, which in the illustrated example are the bushing 22 and the slide stop 120, are removed every time the pistol is disassembled for cleaning Therefore, no special tools are required to install or remove the sights. Because the ends of the channels in which the sights are installed are substantially hidden, the cosmetic disadvantages of other sight installation methods are avoided. Because the firearm components that secure the sights within the channels are themselves quite securely installed on the pistol, the sights are quite securely held within the channels. If fixed sights are utilized, they are easily replaced with sights of different heights, thereby facilitating sight adjustment. Alternatively, the adjustable sights described above facilitate sight adjustment without the need to replace the sights. Because the sights are secured within channels whose open ends are blocked by a removable firearm component, the sights are securely installed, so that the rear sight may safely be utilized to retract the slide 20 by hooking the sight 44 on a belt, the heel of a shoe, or other convenient surface.

A variety of modifications to the above-described embodiments will be apparent to those skilled in the art from this disclosure. For example, if the sight is used with another style of firearm, a different removable slide component, or a removable component of another portion of the firearm, could be used to retain the sight. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A slide assembly for a firearm, comprising:

a slide;

a channel defined within the slide, the channel having an open end disposed at one end of the slide, a closed end disposed opposite the open end, and a pair of channel sides extending therebetween, the channel having a closed bottom surface and open top, the bottom surface having a bottom channel width defined in a direction that is substantially equiangular to the channel sides, the open top having a top channel width defined in a direction that is substantially parallel to the bottom channel width, the bottom channel width being greater than the top channel width;

a sight having a base and a visual index portion, the base fitting within the channel, the visual index portion extending outward from the base;

a removable slide assembly component that covers the open end of the channel, a majority of the removable slide assembly component fitting within a three dimensional periphery of the slide; and the base being dimensioned and configured to resist movement of the base in any direction except towards or away from the open end of the channel when the base is within the channel and the removable slide assembly component is removed from the slide;

whereby removal of the sight from the slide is resisted by interaction of the channel, the base, and the removable slide assembly component, and removal of the removable slide assembly component permits removal of the sight.

2. The slide assembly according to claim 1, wherein:

The sight is a rear sight; and the removable slide component is a firing pin stop.

3. The slide assembly according to claim 1, wherein the sight further comprises:

an upper arm, the upper arm being secured to the base in a manner that permits movement of the upper arm towards and away from the base;

an adjustment device for positioning the upper arm in a desired position relative to the base; and the visual index portion being secured to the upper arm.

4. The slide assembly according to claim 3, wherein:

the base defines a pair of ends;

the upper arm defines a pair of ends;

one end of the upper arm is pivotally secured to one end of the base.

5. The slide assembly according to claim 3, further comprising a spring disposed between the base and the upper arm, the spring being structured to bias the upper arm away from the base.

6. The slide assembly according to claim 3, wherein the adjustment device is a screw, the screw threadedly engaging the base, the screw rotatably engaging the upper arm, the screw having a head disposed above the upper arm.

7. The slide assembly according to claim 3, wherein:

the upper arm defines a channel, the upper arm's channel being substantially perpendicular to the slide assembly;

the visual index portion includes a blade, the blade being slidably mounted within the upper arm's channel; and the visual index portion includes an adjustment device for permitting movement of the blade, and for securing the blade in a desired position within the upper arm's channel.

8. The slide assembly according to claim 1, wherein the base is held within the channel by an interference fit; whereby the sight may be removed from the slide by finger pressure when the removable slide assembly component is removed from the slide.

9. The slide assembly according to claim 1, wherein:

the slide defines a longitudinal axis; and the channel extends substantially parallel to the longitudinal axis of the slide.

10. The slide assembly according to claim 1, wherein the removable slide assembly component secures at least one other firearm component in place.

11. The slide assembly according to claim 1, wherein the base further comprises:

a lower base portion defining a lower base width extending in a direction that is substantially parallel to the bottom channel width when the base is installed within the channel, the lower base width being greater than the top channel width;

an upper base portion defining an upper base width extending in a direction that is substantially parallel to the lower base width, the upper base width being smaller than the lower base width.

12. A firearm, comprising:

a channel defined within an exterior surface of a sight supporting component of the firearm, the sight supporting component holding at least one internal firearm component in place within the firearm, the channel having an open end disposed at one end of the exterior surface, a closed end disposed opposite the open end, and a pair of sides extending therebetween, the channel having a closed bottom surface and open top, the bottom surface having a bottom channel width defined in a direction that is substantially equiangular to the channel sides, the top having a top channel width defined in a direction that is substantially parallel to the bottom channel width, the bottom channel width being greater than the top channel width;

a sight having a base and a visual index portion, the base fitting within the channel, the visual index portion extending outward from the base; and a removable firearm component that covers the open end of the channel, a majority of the removable firearm component fitting within a three dimensional periphery of the sight supporting component; and the base being dimensioned and configured to resist movement of the base in any direction except towards or away from the open end of the channel when the base is within the channel and the removable firearm component is removed from the firearm;

whereby removal of the sight from the sight supporting component is resisted by interaction of the channel, the base, and the removable firearm component, and removal of the removable firearm component permits removal of the sight.

13. The firearm according to claim 12, wherein the sight further comprises:

an upper arm, the upper arm being secured to the base in a manner that permits movement of the upper arm towards and away from the base;

an adjustment device for positioning the upper arm in a desired position relative to the base; and the visual index portion being secured to the upper arm.

14. The firearm according to claim 13, wherein:

the base defines a pair of ends;

the upper arm defines a pair of ends;

one end of the upper arm is pivotally secured to one end of the base.

15. The firearm according to claim 13, further comprising a spring disposed between the base and the upper arm, the spring being structured to bias the upper arm away from the base.

16. The firearm according to claim 13, wherein the adjustment device is a screw, the screw threadedly engaging the base, the screw rotatably engaging the upper arm, the screw having a head disposed above the upper arm.

17. The firearm according to claim 13, wherein:

the upper arm defines a channel, the upper arm's channel being substantially perpendicular to a longitudinal axis of the firearm;

the visual index portion includes a blade, the blade being slidably mounted within the upper arm's channel; and the visual index portion includes an adjustment device for permitting movement of the blade, and for securing the blade in a desired position within the upper arm's channel.

18. The firearm according to claim 12, wherein the base is held within the channel by an interference fit; whereby the sight may be removed from the firearm by finger pressure when the removable firearm component is removed from the firearm.

19. The firearm according to claim 12, wherein:

the firearm defines a longitudinal axis; and the channel extends substantially parallel to the longitudinal axis of the firearm.

20. The firearm according to claim 12, wherein the removable firearm component secures at least one other firearm component in place.

21. The firearm according to claim 12, wherein the base further comprises:

a lower base portion defining a lower base width extending in a direction that is substantially parallel to the bottom channel width when the base is installed within the channel, the lower base width being greater than the top channel width;

an upper base portion defining an upper base width extending in a direction that is substantially parallel to the lower base width, the upper base width being smaller than the lower base width.

* * * * *